US005836027A

United States Patent [19]

Leventhal et al.

[11] Patent Number: 5,836,027

[45] Date of Patent: Nov. 17, 1998

[54] INTEGRATED MATRIX BEDDING SYSTEM

[76] Inventors: Robert D. Leventhal, 2548 Micheltorena, Los Angeles, Calif. 90039; Paul B. Thomas, 1257 W. O'Farrell St., San Pedro, Calif. 90731

[21] Appl. No.: 837,871

[22] Filed: Apr. 25, 1997

[51] Int. Cl.[6] ..... A47C 27/18

[52] U.S. Cl. ..... 5/706; 5/710; 5/713; 5/727; 5/729; 5/654; 5/655.3; 5/953

[58] Field of Search ..... 5/690, 706, 710, 5/713, 719, 727, 729, 738, 739, 740, 654, 655.3, 953

[56] References Cited

U.S. PATENT DOCUMENTS

| | | | |
|---|---|---|---|
| 2,192,601 | 3/1940 | Mattison | 5/729 |
| 2,434,641 | 1/1948 | Burns | 5/655.3 |
| 2,897,520 | 8/1959 | Bradford | 5/655.3 |
| 3,551,924 | 1/1971 | Frye, Sr. | 5/727 |
| 3,732,586 | 5/1973 | Frey | 5/727 |
| 3,879,776 | 4/1975 | Solen . | |
| 3,959,835 | 6/1976 | Nos | 5/706 |
| 4,005,236 | 1/1977 | Graebe . | |
| 4,120,061 | 10/1978 | Clark . | |
| 4,394,784 | 7/1983 | Swenson et al. | 5/706 |
| 4,454,615 | 6/1984 | Whitney . | |
| 4,629,253 | 12/1986 | Williams . | |
| 4,631,767 | 12/1986 | Carr et al. . | |
| 4,827,546 | 5/1989 | Cvetkovic . | |
| 4,895,352 | 1/1990 | Stumpf . | |
| 4,967,431 | 11/1990 | Hargest et al. . | |
| 5,097,552 | 3/1992 | Viesturs . | |
| 5,331,698 | 7/1994 | Newkirk et al. | 5/710 |
| 5,419,612 | 5/1995 | Rassekhi | 5/654 |
| 5,446,933 | 9/1995 | Gabelhouse | 5/729 |
| 5,666,681 | 9/1997 | Meyer et al. | 5/727 |
| 5,749,111 | 5/1998 | Pearce | 5/654 X |

FOREIGN PATENT DOCUMENTS

| | | | |
|---|---|---|---|
| 2692477 | 12/1993 | France | 5/729 |
| 3739883 | 6/1989 | Germany | 5/713 |

*Primary Examiner*—Kenneth J. Dorner
*Assistant Examiner*—Robert G. Santos
*Attorney, Agent, or Firm*—Thomas I. Rozsa; Tony D. Chen

[57] ABSTRACT

An integrated matrix bedding system includes an air/foam mattress matrix assembly which comprises an airtight structure assembled within a restraining member. The airtight structure has a base with a plurality of compressible and expandable members extending upwardly from the base and arranged in a matrix arrangement. A plurality of connecting tubes are connected to the base and interconnected to two adjacent compressible and expandable members for distributing air between the plurality of compressible and expandable members. The restraining member has a plurality of interior cavities arranged in a matrix arrangement which corresponds and aligns with the compressible and expandable members. The plurality of compressible and expandable members are respectively inserted within the interior cavities of the restraining member.

22 Claims, 11 Drawing Sheets

INTEGRATED MATRIX BEDDING SYSTEM

BACKGROUND OF THE INVENTION

1. Field of the Invention

The present invention generally relates to the field of bed systems. More particularly, the present invention relates to the field of adjustable mattresses for beds.

2. Description of the Prior Art

Specifically, mattresses and beds of different constructions are well known in the art. Many of the mattress constructions have problems which can cause discomfort and disruption to the sleeping process. One of the prior art mattresses is a conventional air mattress which comprises simply a flexible enclosure filled with air. When depressed, the enclosure depresses slightly in the vicinity of the loading and also increases pressure in the remaining volume of the enclosure. The response is resistive and bouncy, which are undesirable characteristics as far as the comfort of the user is concerned.

The following ten (10) prior art patents are found to be pertinent to the field of the present invention:

1. U.S. Pat. No. 3,879,776 issued to Solen on Apr. 29, 1975 for "Variable Tension Fluid Mattress" (hereafter the "Solen Patent");
2. U.S. Pat. No. 4,005,236 issued to Graebe on Jan. 25, 1977 for "Expandable Multicelled Cushioning Structure" (hereafter the "Graebe Patent");
3. U.S. Pat. No. 4,120,061 issued to Clark on Oct. 17, 1978 for "Pneumatic Mattress With Valved Cylinders Of Variable Diameter" (hereafter the "Clark Patent");
4. U.S. Pat. No. 4,454,615 issued to Whitney on Jun. 19, 1984 for "Air Pad With Integral Securement Straps" (hereafter the "Whitney Patent");
5. U.S. Pat. No. 4,629,253 issued to Williams on Dec. 16, 1986 for "Seat Occupant-Activated Underseat Support Air-Cushion" (hereafter the "Williams Patent");
6. U.S. Pat. No. 4,631,767 issued to Carr et al. on Dec. 30, 1986 for "Air Flotation Mattress" (hereafter the "Carr Patent");
7. U.S. Pat. No. 4,827,546 issued to Cvetkovic on May 9, 1989 for "Fluid Mattress" (hereafter the "Cvetkovic Patent");
8. U.S. Pat. No. 4,895,352 issued to Stumpf on Jan. 23, 1990 for "Mattress Or Cushion Spring Array" (hereafter the "Stumpf Patent");
9. U.S. Pat. No. 4,967,431 issued to Hargest et al. on Nov. 6, 1990 for "Fluidized Bed With Modular Fluidizable Portion" (hereafter the "Hargest Patent"); and
10. U.S. Pat. No. 5,097,552 issued to Viesturs on Mar. 24, 1992 for "Inflatable Air Mattress With Straps To Attach It To A Conventional Mattress" (hereafter the "Viesturs Patent").

The Solen Patent discloses a variable tension fluid mattress. It comprises a fluid chamber defined by an upper wall and a bottom wall which form a base. The fluid chamber can be compartmentalized by a longitudinal divider and cross dividers to provide individual zones of the fluid chamber. A plurality of pressure expandable pads are clamped to the upper wall by a disc which is secured to a hollow stem which communicates with the fluid chamber. A restraining chain is mounted within each pad and serves merely to limit the upward expansion of the pad regardless of the internal pressure.

The Graebe Patent discloses an expandable multicelled cushioning structure. It comprises a common base and a plurality of cells which are attached to the base, and are initially in a configuration so that the cells when formed are spaced apart but when later expanded by a pressurized fluid, they will contact or be closely spaced to one another at their sidewalls.

The Clark Patent discloses a pneumatic mattress with valved cylinders of variable diameter. It comprises a plurality of valved cylinder cells held by a cover in a side-by-side relationship. Each cell comprises upper and lower cylindrical sections of equal diameter interconnected by a corrugated cylindrical section which has a smaller diameter. Each lower cylindrical section has an orifice which connects the interior of the cell with an air plenum that extends along the entire underside of the mattress. Each orifice registers with a valve that projects from the inner surface of the plenum opposite the cell orifice and is supported by a small, collapsible section of the cell in a normally open position, so that when a load is applied to the top of the cell it automatically closes the orifice against the registering valve.

The Whitney Patent discloses an air pad with integral securement straps. It comprises an upper layer and a lower layer which are joined together at a heat seal extending around the entire periphery of the pad. The pad is filled with air, water, a gel or the like. Securement straps are provided on the pad and fitted around and under the corners of a standard bed mattress to hold the pad in position on the mattress.

The Williams Patent discloses a seat occupant-activated underseat support air-cushion. It comprises a support base and an airtight expandable air cushion which rests on the support base. The top of the air-cushion is pressed upward against the bottom side of the vehicle seat cushion. A bellows type air pump is disposed within the air cushion and provides an outside air-intake.

The Carr Patent discloses an air flotation mattress. It comprises a lower inflatable chamber with a series of side-by-side air supply channels and an air-pervious upper wall. An inflatable compartment is overlaid on the chamber and forms a secondary air-pervious wall. A fan assembly is operatively coupled with the lower inflatable chamber to supply pressurized air.

The Cvetkovic Patent discloses a fluid mattress. It comprises side frames, a bottom support, and flexible and contractible bellows distributed over the bottom support. Connecting tubings are connected from the bellows to adjacent bellows to permit fluid flow therebetween. A top cover is extended over the bellows. Coil springs are mounted on top of the bellows to support the top cover.

The Stumpf Patent discloses a mattress or cushion spring array. It comprises a plurality of spring units. Each spring unit has a body, a top deformable end, and a bottom deformable end, where the ends are free for axial compression. The spring units are interconnected together by connecting fins which extend from the body of each spring unit.

The Hargest Patent discloses a fluidized bed with a modular fluidizable portion. A plurality of fluidizable cells are disposed and attached atop of an air permeable support. Each cell contains a discrete mass of fluidizable material which can be manually detachable and removable from the support for ease of cleaning and replacement.

The Viesturs Patent discloses an inflatable air mattress with straps to attach it to a conventional mattress. It comprises an upper air impervious flexible layer and a lower air impervious flexible layer. The peripheries of the first and second layer are joined together in air impervious sealed relationship.

None of these prior art patents teach an integrated matrix bedding system, resting or therapeutic structure by two dissimilar constructions to provide a matrix surface that is both supportive and pliable with minimal surface tension. It is desirable to have a very efficient and also very effective design and construction of an integrated matrix bedding system which includes an air structure within a restraining structure for providing comfort and tranquillity to a user in his or her sleeping process by two dissimilar constructions to create a matrix surface that is both supportive and pliable with minimal surface tension.

SUMMARY OF THE INVENTION

The present invention is an integrated matrix bedding system which includes an air/foam mattress matrix assembly. The mattress matrix assembly comprises an airtight structure assembled within a restraining member. The airtight structure has a base with a plurality of compressible and expandable members extending upwardly from the base and arranged in a matrix arrangement (rows and columns). A plurality of connecting tubes are interconnected to the base and interconnected to two adjacent compressible and expandable members for distributing air between the plurality of compressible and expandable members. The restraining member has a plurality of interior cavities arranged in a matrix arrangement (rows and columns) which correspond and align with the compressible and expandable members. The plurality of compressible and expandable members are respectively inserted within the interior cavities of the restraining member, and thereby form the present invention integrated matrix bedding system.

It is therefore an object of the present invention to provide a new and improved type of integrated matrix bedding system wherein the construction of a bedding provides a resting or therapeutic structure formed by two dissimilar constructions to create a matrix surface that is both supportive and pliable with minimal surface tension. Pressure exerted upwardly against the weight of a resting body by the restraining member can be adjusted to be less than or greater than the pressure exerted upwardly by the compressible and expandable members. The difference in pressure between the restraining member and the compressible and expandable members creates portions of the mattress matrix assembly that are pliable with minimal surface tension between supportive portions. The stress produced is reduced because the pliable portions can conform to the complex curves of the human form and thus increase the area supported. Stress concentrations are reduced due to the increase in area supported, overall reduction in supportive pressures and minimized surface tension. A more comfortable and therapeutic matrix mattress assembly is thus achieved by the present invention stress reducing features.

It is an additional object of the present invention to provide a new and improved type of integrated matrix bedding system which includes a mattress matrix assembly with a lateral support throughout the mattress matrix assembly by the integrated positioning of the compressible and expandable members when they are set to a higher pressure and stiffness than that of the restraining member, or conversely the restraining member if it exceeds the pressure and stiffness of the compressible and expandable members. The lateral support augments the stress reducing contouring support feature. Because of the lateral support and contact between the two dissimilar constructions, a transitional softening or stiffening interaction is also created by the restraining member compressing about the compressible and expandable members or decompressing relative to the adjusted pressure. The transitional interaction is also enhanced by the shape of the compressible and expandable members. A lifting action with vertical and horizontal components is provided by the compressible and expandable member's lower wedge shape beneath the restraining member. The lifting component provides for an increase or decrease in height of the restraining member around the compressible and expandable members relative to the adjusted pressure.

It is a further object of the present invention to provide a new and improved type of integrated matrix bedding system so additional comfort is created by the mattress matrix assembly's ability to adjust the relative pressure over a large range to suit the various shapes and masses of resting bodies. The compressible and expandable members can be further customized to suit individuals by utilizing zoned construction fostered by both its fluid system and matrix design. Also inherent in the basic design is the ability to dynamically adapt to a variety of changing resting positions by the proper sizing of the same interconnection of the compressible and expandable members required for pressurization a zone or the entire structure.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Described briefly, the present invention is an integrated matrix bedding system. The concept of the present invention is the construction of a bedding, resting or therapeutic structure by two dissimilar constructions to create a matrix surface that is both supportive and pliable with minimal surface tension.

Figure 1:
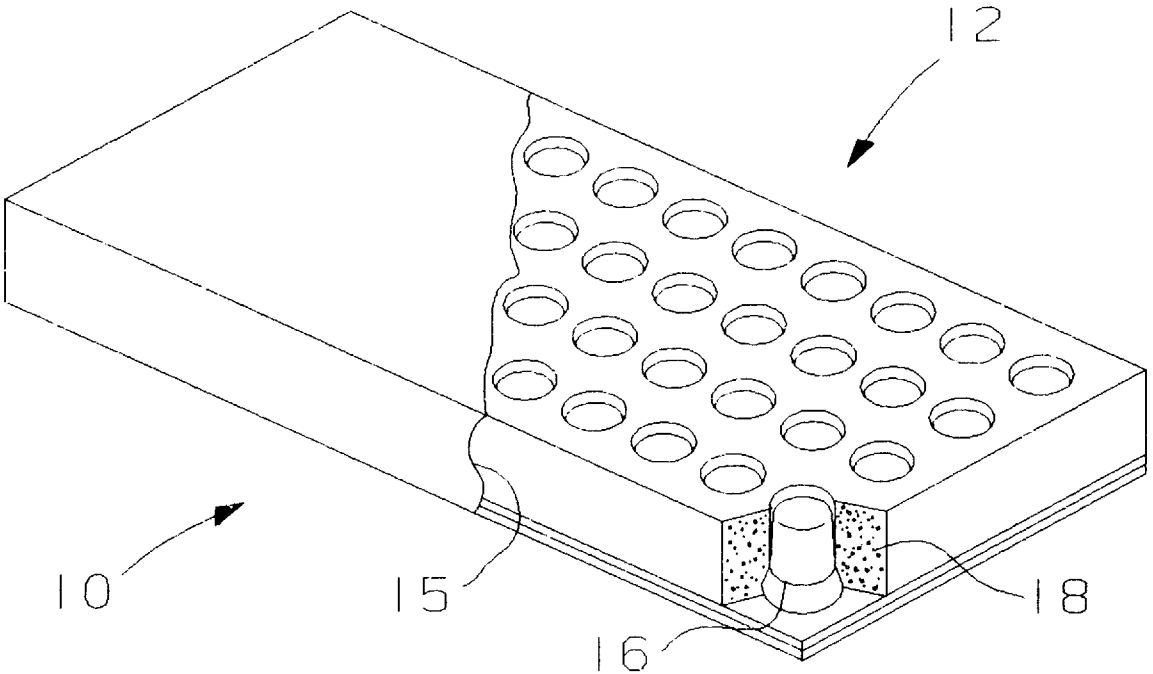
FIG. 1 is a partial perspective view of the present invention integrated matrix bedding system, showing an air/foam mattress matrix assembly.

Referring to FIG. 1, there is shown at 10 a preferred embodiment of the present invention integrated matrix bedding system. The bedding system 10 comprises an air/foam mattress matrix assembly 12 and a mattress cover 15 which extends over the entire air/foam mattress matrix assembly 12, and may also include a cushion layer (not shown).

Figure 2:
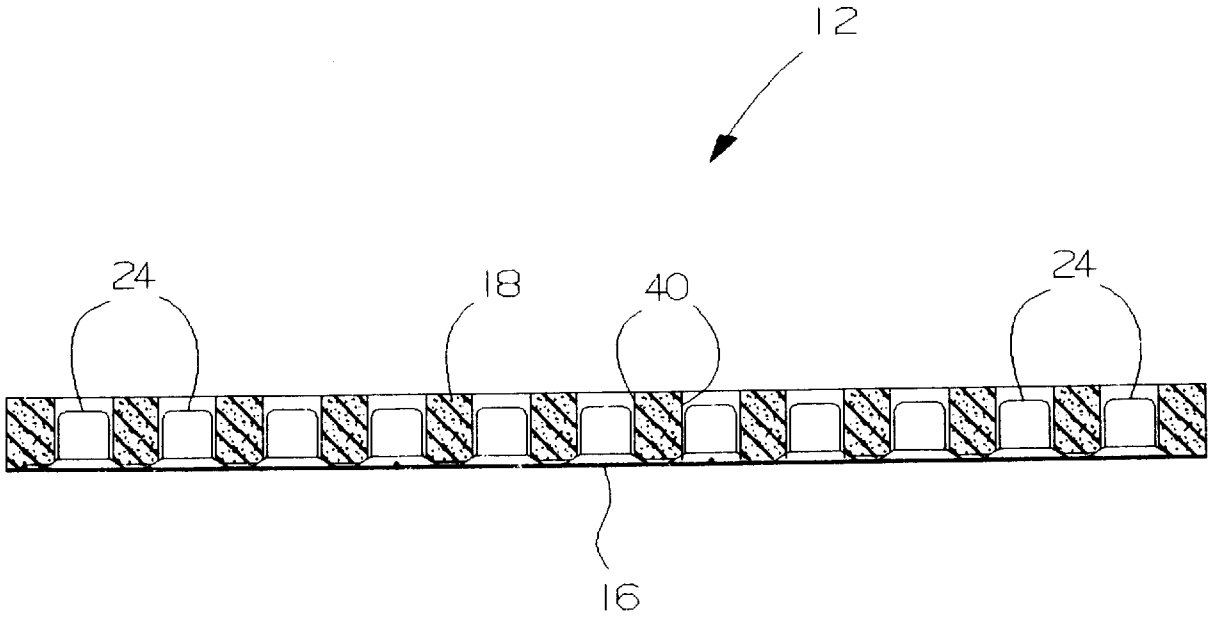
FIG. 2 is a partial longitudinal cross-sectional view of the air/foam mattress matrix assembly.
Figure 3:
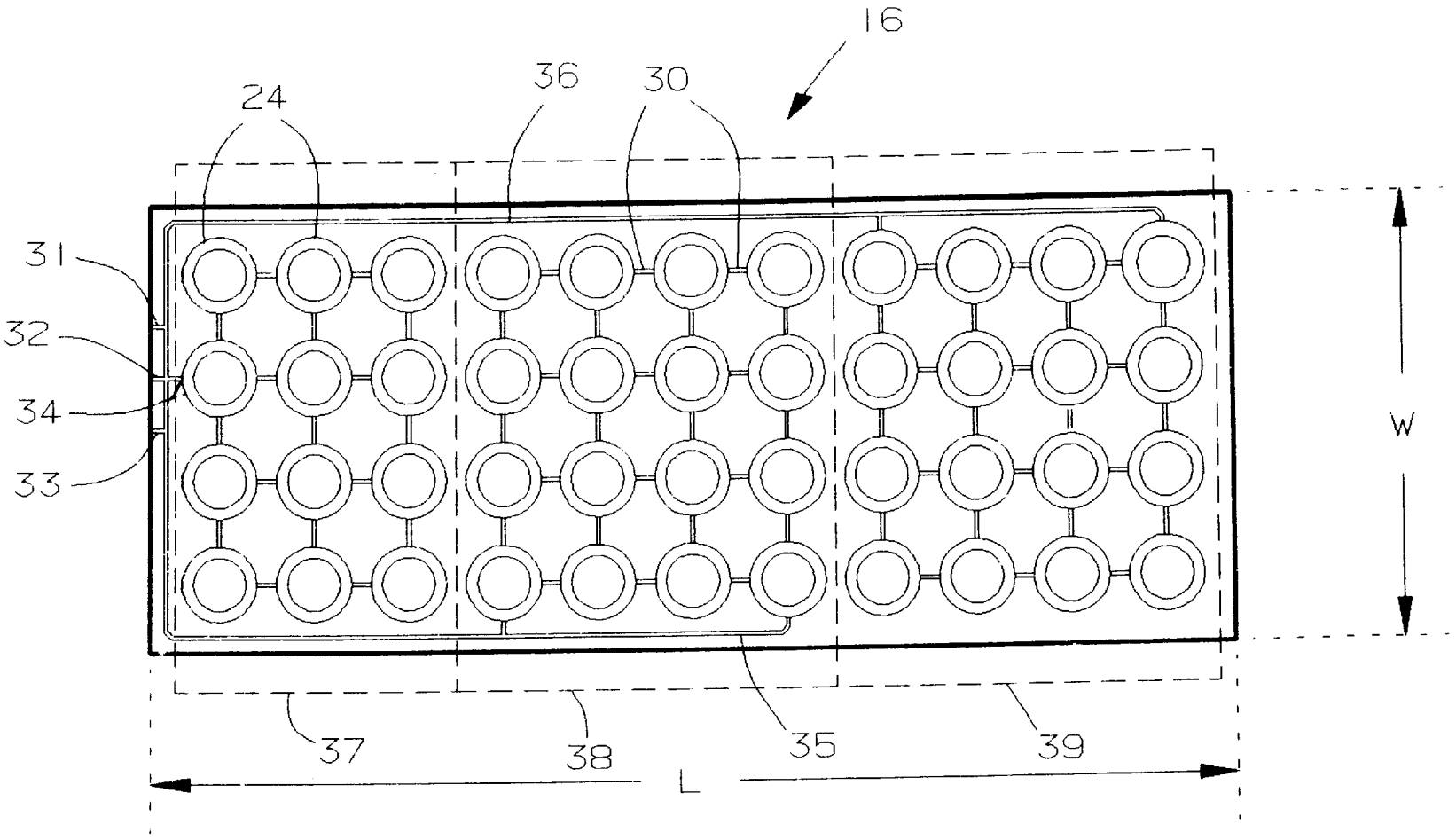
FIG. 3 is a top plan view of an airtight structure with a plurality of compressible and expandable members.

Referring to FIGS. 2 and 3, the mattress assembly 12 includes an airtight and fluid-tight structure 16 and a foam structure or vertical restraining member 18. Both of these structures 16 and 18 are generally rectangular shaped. By way of example, the overall length "L" and width "W" of the airtight and fluid-tight structure 16 are approximately 71.50 inches by 29.25 inches respectively. It will be appreciated that the dimensions described above are merely one illustrative embodiment, and it is within the spirit and scope of the present invention to include many other comparable sets of dimensions.

Figure 4:
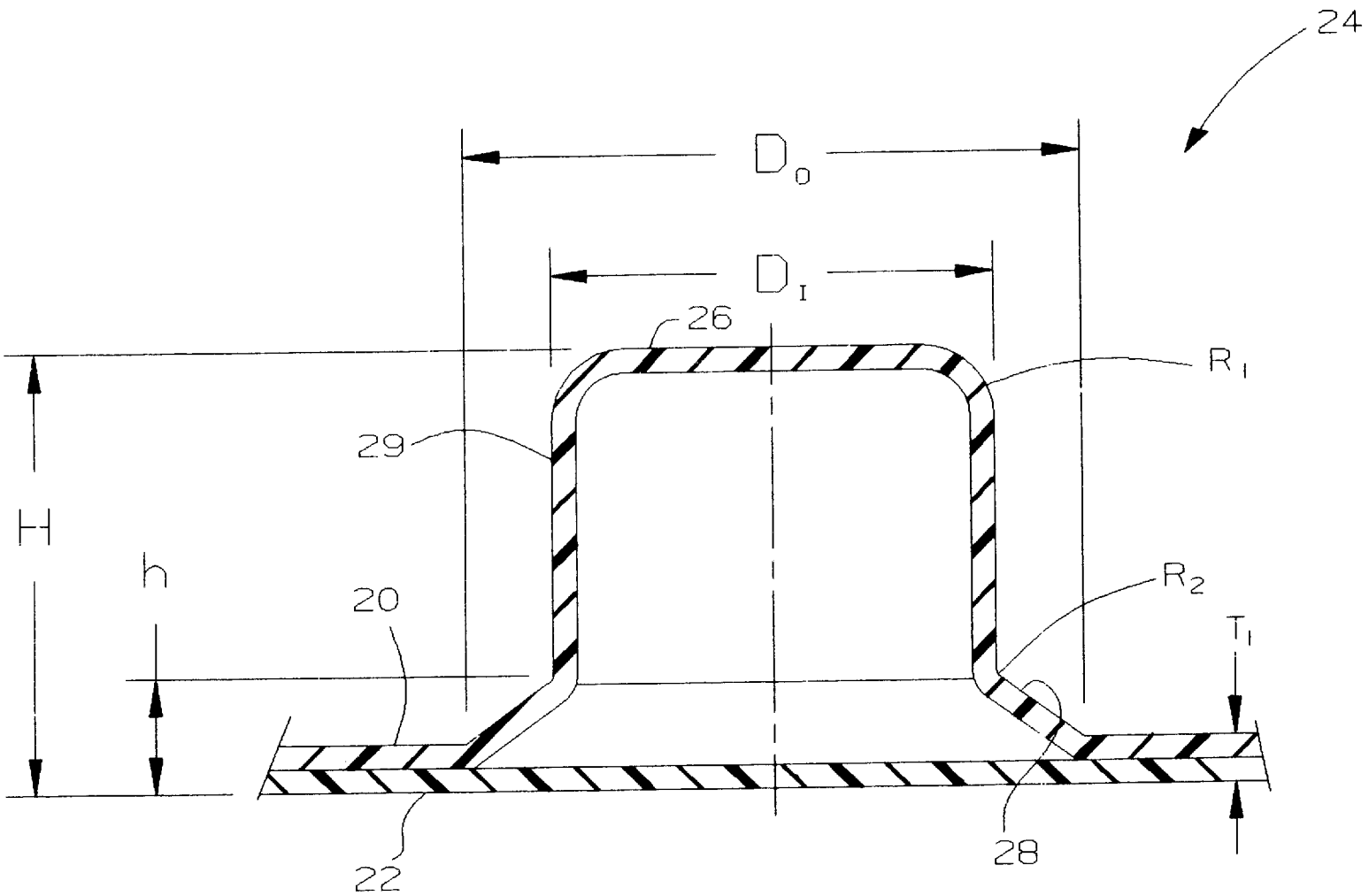
FIG. 4 is an enlarged cross-sectional view of one of the plurality of compressible and expandable members of the air/foam mattress matrix assembly.

Referring to FIGS. 2, 3 and 4, the airtight and fluid-tight structure 16 has a flexible top layer 20 with a plurality of spaced apart vertical adjustable cylindrical shaped glands 24 and a generally flat flexible bottom layer 22. The top layer 20 is affixed to the bottom layer 22 by ultrasonic welding, radio frequency (RF) and heat welding or other suitable means. By way of example, the thickness "$T_1$" of the two layers 20 and 22 when combined is approximately 0.25 inch.

The plurality of adjustable cylindrical shaped glands 24 are substantially identical, and to the extent they are, only one will be described in detail below. Each cylindrical shaped gland 24 has a narrow closed distal end 26, a wide open wedge shaped proximal end 28, and a circumferential straight sidewall 29 adjoined to the wedge shaped proximal end 28. The wide open wedge shaped proximal end 28 of each cylindrical shaped gland 24 is integrally formed with the top layer 20 of the airtight structure 16. The plurality of cylindrical shaped glands 24 are arranged in a matrix arrangement (rows and columns) and are compressible and expandable when a downward pressure is applied to them (see FIGS. 8, 9 and 10). By way of example, the height "H" of each cylindrical shaped gland 24 is approximately 2.25 inches, the height "h" of the wide open wedge shaped proximal end 28 is approximately 0.75 inch. Each cylindrical shaped gland 24 has two different diameters. By way of example, the outer diameter "$D_O$" of each cylindrical shaped gland 24 is approximately 5.00 inches, while the inner diameter "$D_I$" is approximately 3.25 inches. In addition, the top annular rim of each cylindrical shaped gland 24 has a curvature "$R_1$" which is approximately 0.50 inch. There is also a curvature "$R_2$" which is approximately 0.12 inch, where the wedge proximal end 28 joins the circumferential straight sidewall 29. By way of example, two adjacent glands 24 are spaced apart from each other approximately 6.75 inches from center to center in the transverse direction, while two adjacent glands 24 are spaced apart from each other approximately 6.25 inches from center to center in the longitudinal direction.

Referring to FIGS. 2 and 3, there are shown a plurality of connecting tubes 30 which are substantially identical, and to the extent they are, only one will be described in detail. Each connecting tube 30 is integrally formed with the top layer 20 of the airtight and fluid-tight structure 16, where each connecting tube 30 is respectively interconnected to two adjacent glands 24 for allowing air to flow between the plurality of cylindrical shaped glands 24.

Referring to FIG. 3, the airtight and fluid structure 16 is also provided with three inlet ports 31, 32 and 33 for supplying air under pressure to a main air line 34, a first air line 35, and a second air line 36. These three air lines 34, 35 and 36 are routed within the airtight structure 16 to supply air to the plurality of cylindrical shaped glands 24. By way of example, the main air line 34 may be interconnected to a first group 37 of cylindrical shaped glands, the first air line 35 may be interconnected to a second group 38 of cylindrical shaped glands, and the second air line 36 may be interconnected to a third group 39 of cylindrical shaped glands. The airtight structure 16 may be further customized to suit individuals by utilizing zoned construction fostered by both its fluid system and matrix design. FIG. 3 shows the zoning distribution in dashed lines, where the airtight structure 16 may include at least three different zones 37, 38 and 39 therein. To fill the airtight structure 16, air, or the like, is adapted to be supplied to the plurality of cylindrical shaped glands in the airtight structure 16 by inlet ports 31, 32 and 33 which have conventional valves (not shown), which operate in a known manner to control the flow of gas into or out of the airtight structure 16. In the preparation of the airtight structure 16 for use, the valves are open, so that any air under pressure is supplied through air lines 34, 35 and 36 to connecting tubes 30 which in turn supplies the air under pressure to all of the cylindrical shaped glands 24. The plurality of cylindrical shaped glands are inflated to a desired stiffness. When the airtight structure 16 has been filled with the desired amount of air, the inlet ports 31, 32 and 33 are closed off by suitable caps (not shown).

Figure 5:
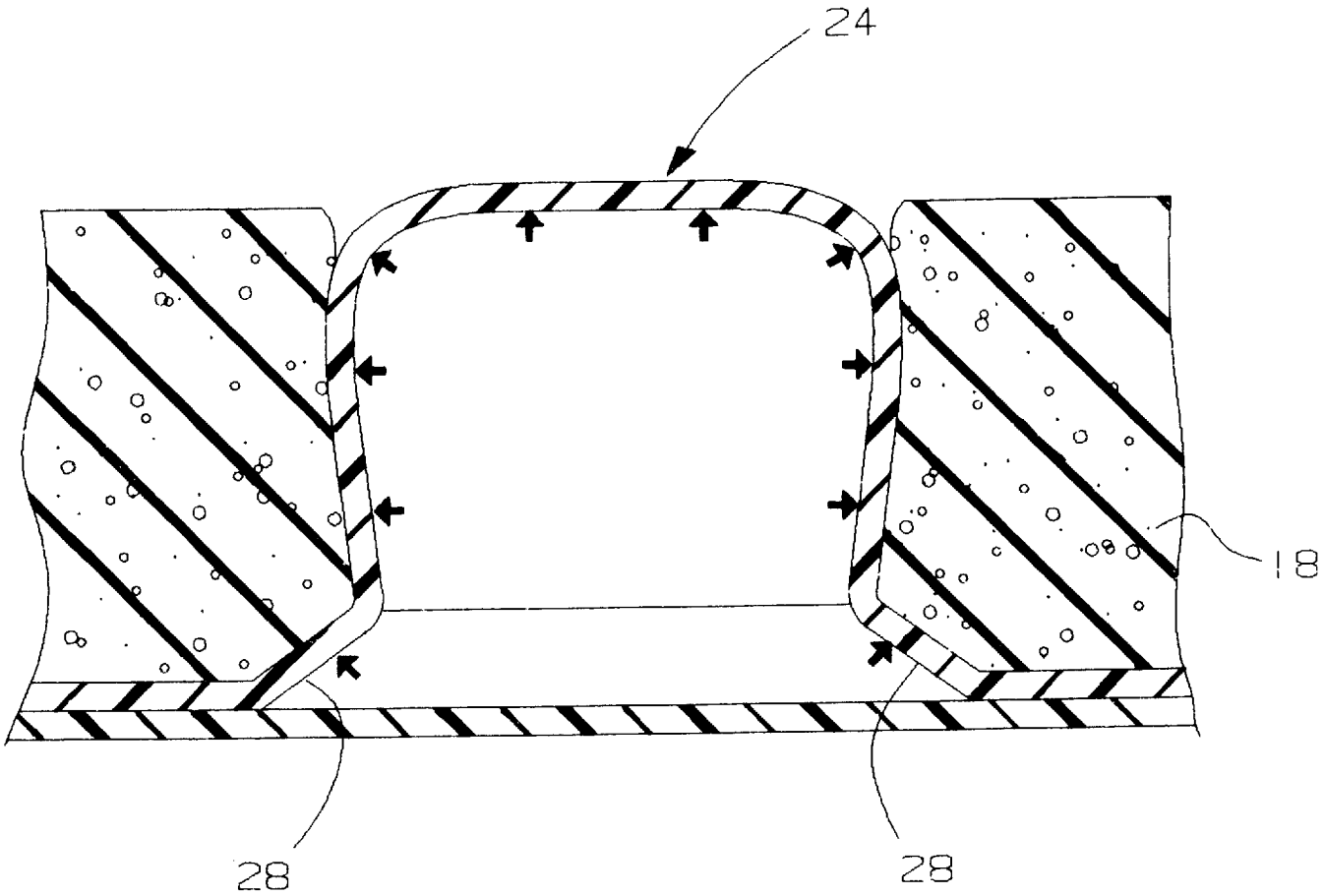
FIG. 5 is a partial enlarged cross-sectional view one of the plurality of compressible and expandable members engaging a foam structure, where air in the compressible and expandable member is stiffer and supports the foam structure.
Figure 6:
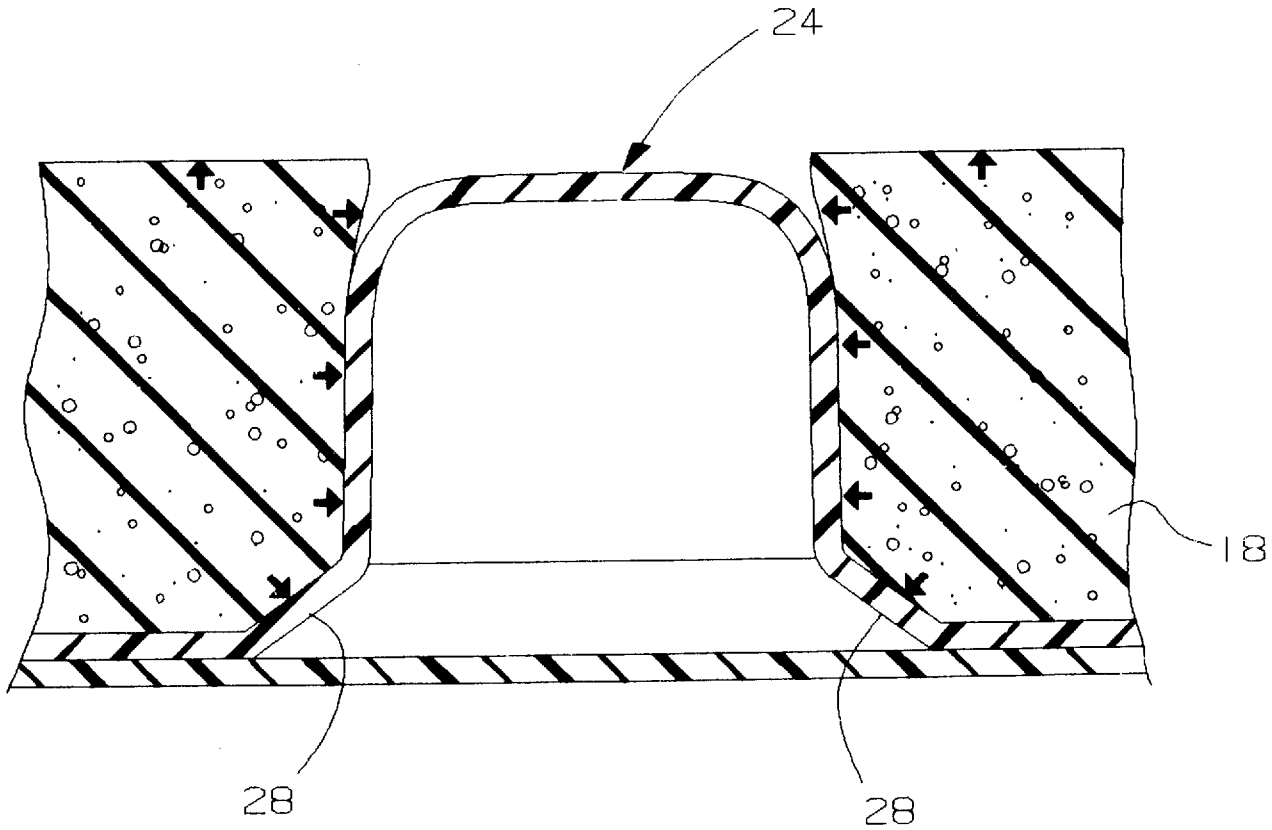
FIG. 6 is a partial enlarged cross-sectional view one of the plurality of compressible and expandable members engaging a foam structure, where the foam structure is stiffer and supports the air within the compressible and expandable member.
Figure 7:
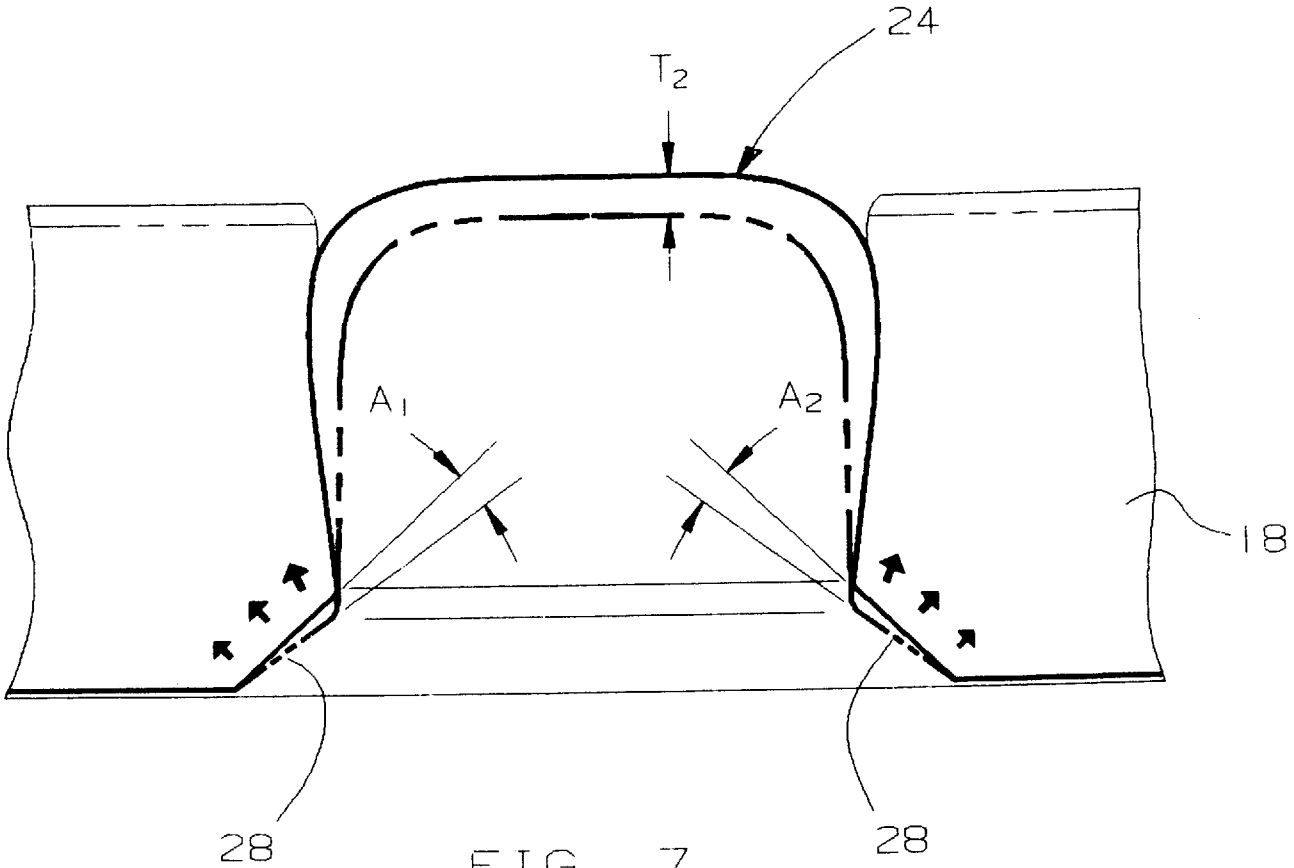
FIG. 7 is an illustration of one of the compressible and expandable members engaging the foam structure, showing the lifting effect of the compressible and expandable member lifting the foam structure.
Figure 11:
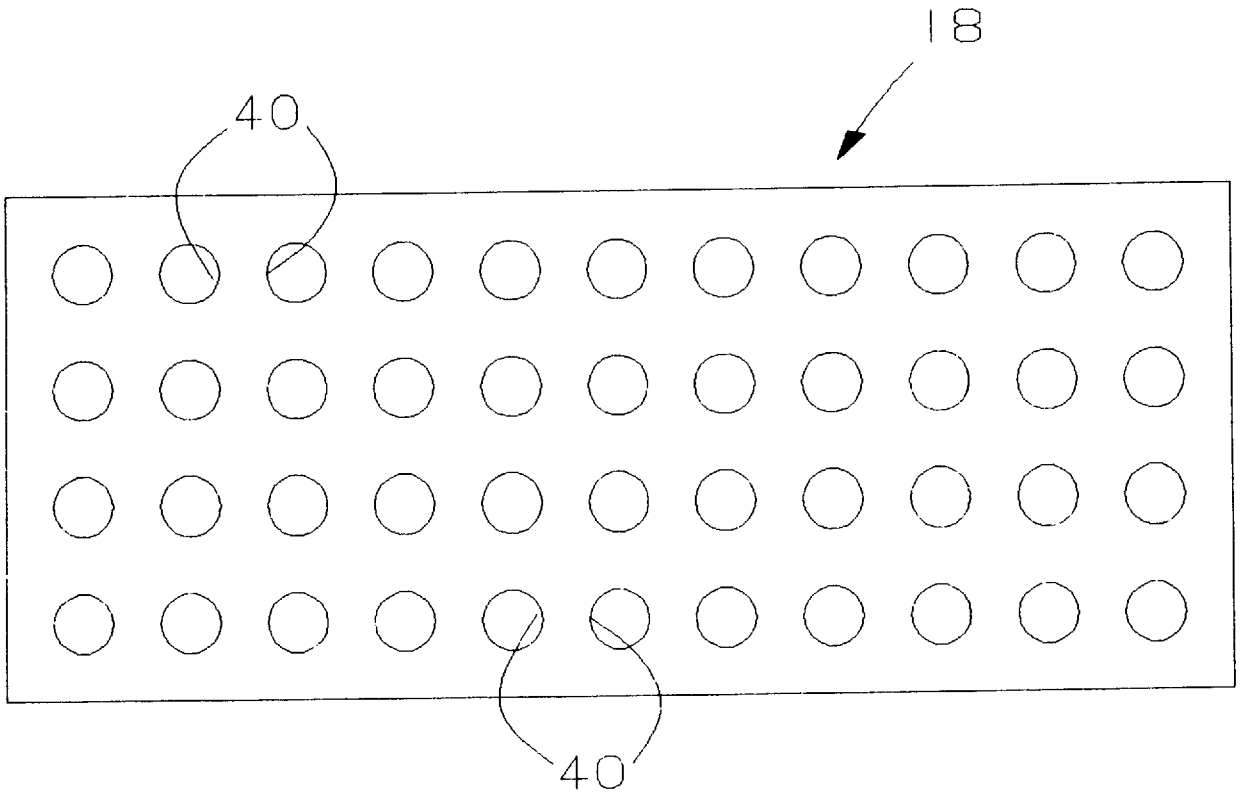
FIG. 11 is a top plan view of the foam structure of the air/foam mattress matrix assembly.

Referring to FIGS. 1, 2 and 11, there are shown the foam structure 18 of the present invention integrated matrix bedding system. The foam structure 18 has a plurality of vertical interior cylindrical shaped cavities 40 arranged in a matrix arrangement (rows and columns). The plurality of interior cavities 40 are substantially identical, and to the extent they are, only one will be described in detail below. Each interior cavity 40 is sized to snugly fit one of the plurality of cylindrical shaped glands 24. The foam structure 18 is assembled on top of the airtight structure 16 by respectively inserting the plurality of glands 24 into the plurality of interior cavities 40, where each interior cavity 40 respectively surrounds each adjustable cylindrical shaped gland 24. The foam structure 18 prevents lateral movements of the plurality of adjustable cylindrical shaped glands 24. The foam structure 18 rests against the top layer 20 of the airtight structure 16 such that the wedge shaped proximal ends 28 of the plurality of adjustable cylindrical shaped glands 24 interact with the foam structure 18 (see FIGS. 5, 6 and 7). These wedge shaped proximal ends 28 provides a lifting effect to lift the foam structure 18 so that when air flows within each cylindrical shaped gland 24, the wedge shaped proximal end 28 lifts the foam structure 18, thereby providing a lifting effect for an increase or decrease in height of the foam structure 18 around the cylindrical shaped gland 24 relative to the adjusted pressure (see FIG. 7). FIG. 5 illustrates that when the air within the gland 24 is stiffer that the foam structure 18, then the air within the gland 24 supports the foam structure 18. FIG. 6 illustrates that when there is less air within the gland 24, the foam structure 18 is stiffer and supports the air within the gland 24. FIG. 7 illustrates the lifting effect of the wedge proximal end 28 of the gland 24 relative to the foam structure 18, where angles "$A_1$" and "$A_2$" are approximately in the range of 15°–45° and "$T_2$" is proportional to angles "$A_1$" and "$A_2$".

Figure 8:
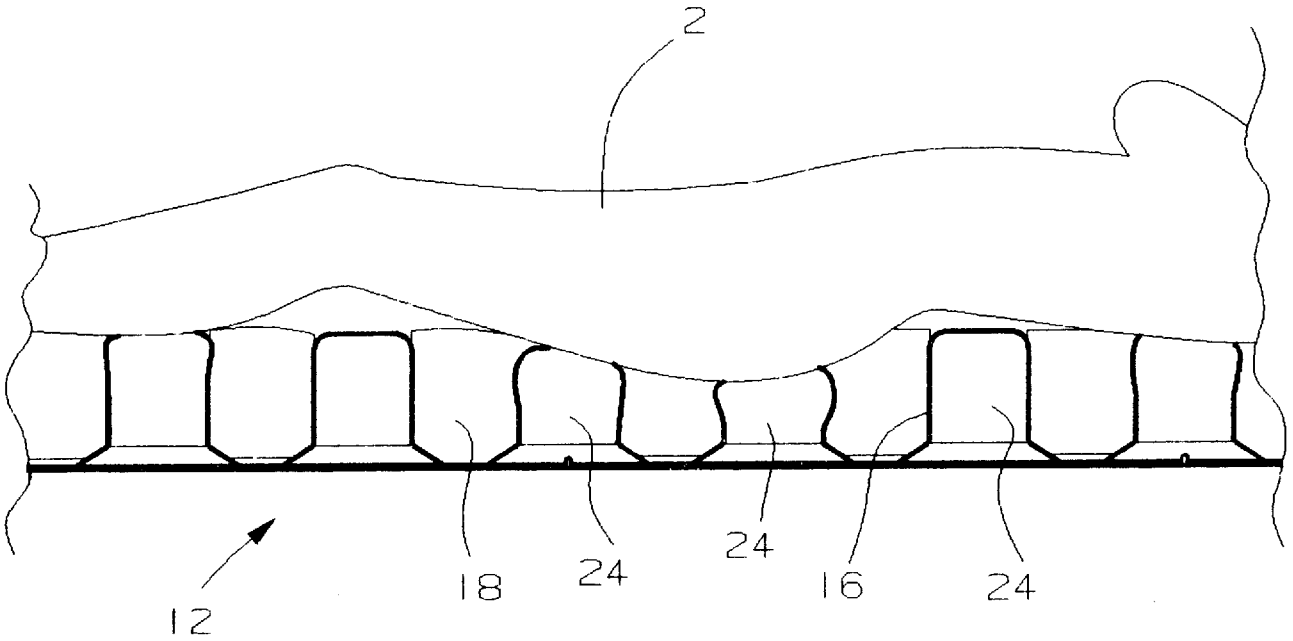
FIG. 8 is an illustration of a human body compressing selected ones of the compressible and expandable members, showing uneven distribution of the load on a greater area, so that stress is reduced.
Figure 9:
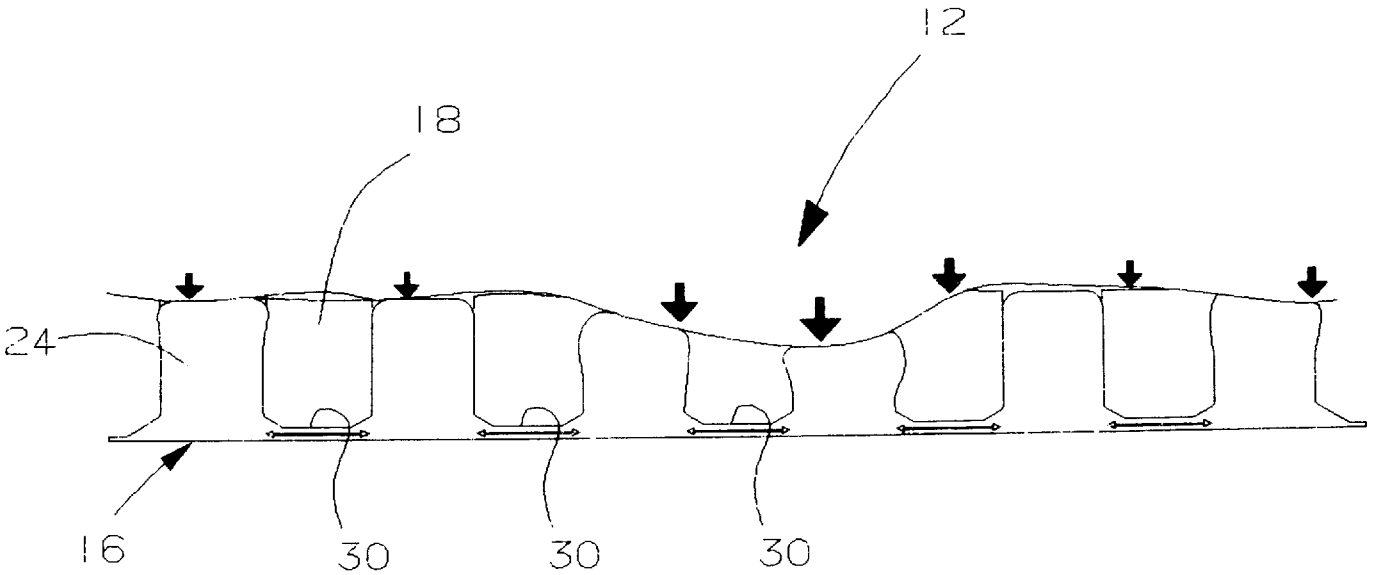
FIG. 9 illustrates the air/foam mattress matrix assembly automatically readjusting itself by air flow between the compressible and expandable members.
Figure 10:
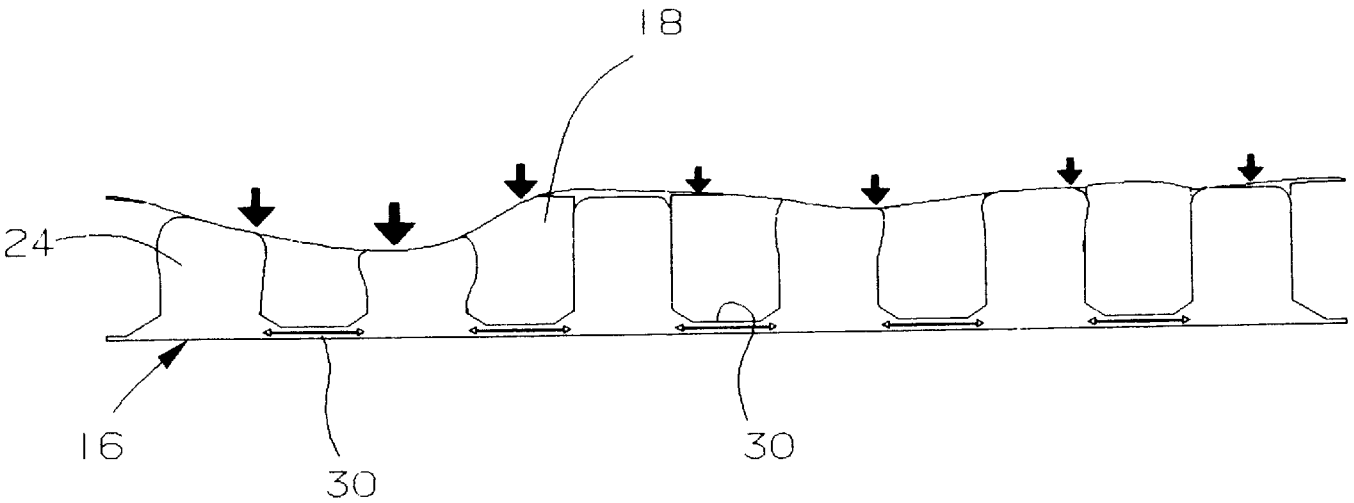
FIG. 10 also illustrates the air/foam mattress matrix assembly automatically readjusting itself by air flow between the compressible and expandable members.

Referring to FIGS. 8, 9 and 10, when a human body 2 rests on top of the mattress assembly 12, pressure is exerted on compressed cylindrical shaped glands 24. Where the force is heaviest, such as the buttock of the human body 2 as illustrated in FIG. 8, air under pressure is transferred from the compressed glands to lesser compressed glands. Pressure exerted upward against the weight of a resting body 2 by the foam structure 18 can be adjusted to be less than or greater than the pressure exerted upwards by the airtight structure 16 of the air/foam mattress assembly 12 (see FIGS. 5 and 6). The difference in pressure between the foam structure 18 and the glands 24 creates portions of the air/foam mattress assembly 12 that are pliable with minimal surface tension between supportive portions. The stress (pressure over area, P/A) produced is reduced because the pliable portions can conform to the complex curves of the human form 2 and thus increase the area (A) supported (see FIG. 8). Stress concentrations are reduced due to the increase in area supported, overall reduction in supportive pressures and minimized surface tension. A more comfortable and therapeutic structure is thus achieved by the present invention stress reducing features.

Additionally, lateral support is provided throughout the air/foam mattress assembly 12 by the integrated positioning of the plurality of cylindrical shaped glands 24 of the airtight structure 16 when it is set to a higher pressure and stiffness than that of the foam structure 18, or conversely, lateral support is provided by the foam structure 18 if it exceeds the pressure and stiffness of the plurality of cylindrical shaped glands 24 of the airtight structure. The lateral support augments the stress reducing contouring support feature. Because of the lateral support and contact between the two constructions, a transitional softening or stiffening interaction is also created by the foam structure 18 compressing about the cylindrical shaped glands 24 or decompressing relative to the adjusted pressure (see FIGS. 5 and 6). The transitional interaction is also enhanced by the shape of the cylindrical shaped glands 24. A lifting action with vertical and horizontal components is provided by the proximal wedge shaped ends 28 of the glands 24 beneath the foam structure 18. The lifting component provides for an increase or decrease in height of the foam structure 18 around the glands 24 relative to the adjusted pressure (see FIG. 7).

Additional comfort is created by the air/foam mattress assembly 12 ability to adjust the relative pressure over a large range to suit the various shapes and masses of resting bodies (see FIGS. 9 and 10), where the arrows show the pressure on that particular spot. Also inherent in the air/foam mattress assembly basic design is the ability to dynamically adapt to a variety of changing resting positions by the proper sizing of the same interconnection of glands required for pressurization a zone or the entire structure.

Referring to FIG. 1, the air/foam mattress assembly 12 may be positioned on top of a box spring (not shown). The present invention integrated matrix bedding system 10 conforms to conventional forms of manufacture, or any other conventional way known to one skilled in the art. The elements of the present invention integrated matrix bedding system 10 can be made from several materials. The manufacturing process which could accommodate the construction of the present invention bedding system may be injection, thermoform, etc. or other molding process. By way of example, the airtight structures 16 of the air/foam mattress assembly 12 can be made from urethane material, vinyl material or any other suitable material.

It will be appreciated that the air/foam mattress matrix assembly 12 can be manufactured as a topper which is known in the bed industry. Using the teaches of the present invention, the topper may have a shorter height than that of the air/foam mattress matrix assembly 12.

Defined in detail, the present invention is a mattress, comprising: (a) an airtight and fluid-tight structure having a flexible top layer and a flexible bottom layer affixed to the flexible top layer to form a plurality of spaced apart vertical adjustable cylindrical shaped glands, each cylindrical shaped glands being compressible and expandable and having a widened open wedge shaped proximal end integrally formed with the top layer and a narrow closed distal end, the plurality of vertical adjustable cylindrical shaped glands arranged in a matrix; (b) a plurality of connecting tubes integrally formed with the top layer of the airtight and fluid-tight structure, each connecting tube respectively interconnected to two adjacent cylindrical shaped glands; (c) means for supplying air under pressure to inflate the plurality of adjustable cylindrical shaped glands to a desired stiffness, such that the air is being transferrable from the plurality of cylindrical shaped glands by the plurality of connecting tubes; (d) a foam structure having a plurality of vertical interior cavities arranged in a matrix, each interior cavity respectively receiving one of the plurality of adjustable cylindrical shaped glands such that the each of the plurality of adjustable cylindrical shaped glands is supported by the foam structure for preventing lateral movements of the plurality of adjustable cylindrical shaped glands, where the foam structure abuts against the each wedge proximal end of each of the plurality of adjustable cylindrical shaped glands for providing a lifting effect to lift the foam structure to a height relative to an adjusted pressure; and (e) whereby the mattress has the ability to adjust the relative pressure over a large range to suit the various shapes and masses of resting bodies.

Defined broadly, the present invention is a mattress, comprising: (a) an airtight structure having a generally flat base and a plurality of spaced apart adjustable cylindrical glands, each cylindrical shaped glands having a wedge proximal end integrally formed with the flat base and a narrow closed distal end and being compressible and expandable; (b) a plurality of connecting tubes integrally formed with the flat base of the airtight structure, each connecting tube respectively interconnected to two adjacent cylindrical shaped glands; (c) means for supplying air under pressure to inflate the plurality of adjustable cylindrical shaped glands to a desired stiffness, such that the air is being transferrable from the plurality of adjustable cylindrical shaped glands by the plurality of connecting tubes; and (d) a foam structure having a plurality of interior cavities, each interior cavity respectively receiving one of the plurality of adjustable cylindrical shaped glands such that the each adjustable cylindrical shaped glands is supported by the foam structure for preventing lateral movements of the plurality of adjustable cylindrical shaped glands, where the foam structure abuts against the each wedge proximal end of each of the plurality of adjustable cylindrical shaped glands for providing a lifting effect to lift the foam structure to a height relative to an adjusted pressure; (e) whereby the mattress has the ability to adjust the relative pressure over a large range to suit the various shapes and masses of resting bodies.

Defined more broadly, the present invention is a mattress, comprising: (a) an airtight structure having a base and a plurality of compressible and expandable members; (b) a plurality of connecting tubes interconnected to the base of the airtight structure, each connecting tube respectively connected to at least two adjacent compressible and expandable members; (c) means for supplying air under pressure to inflate the plurality of compressible and expandable members to a desired stiffness, such that the air is being transferrable from the plurality of compressible and expandable members by the plurality of connecting tubes; and (d) a restraining member having a plurality of cavities, each cavity respectively receiving one of the plurality of compressible and expandable members such that each of the plurality of compressible and expandable is supported by the restraining member for preventing lateral movements of the plurality of compressible and expandable members; (e) whereby the mattress have the ability to adjust the relative pressure over a large range to suit the various shapes and masses of resting bodies.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A mattress, comprising:

a. an airtight and fluid-tight structure having a flexible top layer and a flexible bottom layer affixed to the flexible top layer to form a plurality of spaced apart vertical adjustable cylindrical shaped glands, each cylindrical shaped glands being compressible and expandable and having a widened open wedge shaped proximal end integrally formed with the top layer and a narrow closed distal end, the plurality of vertical adjustable cylindrical shaped glands arranged in a matrix;

b. a plurality of connecting tubes integrally formed with said top layer of said airtight and fluid-tight structure, each connecting tube respectively interconnected to two adjacent cylindrical shaped glands;

c. means for supplying air under pressure to inflate said plurality of adjustable cylindrical shaped glands to a desired stiffness, such that the air is respectively transferrable from said plurality of cylindrical shaped glands by said plurality of connecting tubes;

d. a foam structure having a plurality of vertical interior cavities arranged in a matrix, each interior cavity respectively receiving one of said plurality of adjustable cylindrical shaped glands such that each of said plurality of adjustable cylindrical shaped glands is supported by the foam structure for preventing lateral movements of said plurality of adjustable cylindrical shaped glands, where the foam structure abuts against each wedge proximal end of each of said plurality of adjustable cylindrical shaped glands for providing a lifting effect to lift said foam structure to a height relative to an adjusted pressure; and e. whereby said mattress has the ability to adjust the relative pressure over a large range to suit the various shapes and masses of resting bodies.

2. The mattress in accordance with claim 1 further comprising a mattress cover for covering said airtight structure and said foam structure.

3. The mattress in accordance with claim 1 wherein said airtight and fluid-tight structure is made from vinyl material.

4. The mattress in accordance with claim 1 wherein said airtight and fluid-tight structure is made from urethane material.

5. The mattress in accordance with claim 1 wherein said means for supplying air under pressure includes at least three inlet ports integrally formed with said top layer of said airtight structure.

6. The mattress in accordance with claim 1 wherein said plurality of cylindrical shaped glands are divided into at least two different zones for providing different pressures.

7. A mattress, comprising:

a. an airtight structure having a generally flat base and a plurality of spaced apart adjustable cylindrical glands, each cylindrical shaped glands having a wedge proximal end integrally formed with the flat base and a narrow closed distal end and being compressible and expandable;

b. a plurality of connecting tubes integrally formed with said flat base of said airtight structure, each connecting tube respectively interconnected to two adjacent cylindrical shaped glands;

c. means for supplying air under pressure to inflate said plurality of adjustable cylindrical shaped glands to a desired stiffness, such that the air is being transferrable from said plurality of adjustable cylindrical shaped glands by said plurality of connecting tubes; and d. a foam structure having a plurality of interior cavities, each interior cavity respectively receiving one of said plurality of adjustable cylindrical shaped glands such that each adjustable cylindrical shaped glands is supported by the foam structure for preventing lateral movements of said plurality of adjustable cylindrical shaped glands, where the foam structure abuts against each wedge proximal end of each of said plurality of adjustable cylindrical shaped glands for providing a lifting effect to lift the foam structure to a height relative to an adjusted pressure;

e. whereby said mattress has the ability to adjust the relative pressure over a large range to suit the various shapes and masses of resting bodies.

8. The mattress in accordance with claim 7 further comprising a mattress cover for covering said airtight structure and said foam structure.

9. The mattress in accordance with claim 7 wherein said airtight structure is made from vinyl material.

10. The mattress in accordance with claim 7 wherein said airtight structure is made from urethane material.

11. The mattress in accordance with claim 7 wherein said means for supplying air under pressure includes at least one inlet port integrally formed with said base of said airtight structure.

12. The mattress in accordance with claim 7 wherein said plurality of cylindrical shaped glands are divided into at least two different zones for providing different pressures.

13. The mattress in accordance with claim 7 wherein said plurality of cylindrical shaped glands are arranged in matrix arrangement.

14. A mattress, comprising:

a. an airtight structure having a base and a plurality of compressible and expandable members;

b. a plurality of connecting tubes interconnected to said base of said airtight structure, each connecting tube respectively connected to at least two adjacent compressible and expandable members;

c. means for supplying air under pressure to inflate said plurality of compressible and expandable members to a desired stiffness, such that the air is respectively transferrable from said plurality of compressible and expandable members by said plurality of connecting tubes; and d. a restraining member having a plurality of cavities, each cavity respectively receiving and entirely encompassing one of said plurality of compressible and expandable members such that each of said plurality of compressible and expandable members is supported by the restraining member for preventing lateral movements of said plurality of compressible and expandable members;

e. whereby said mattress have the ability to adjust the relative pressure over a large range to suit the various shapes and masses of resting bodies.

15. The mattress in accordance with claim 14 further comprising a mattress cover for covering said airtight structure and said restraining member.

16. The mattress in accordance with claim 14 wherein said airtight structure is made from urethane material.

17. The mattress in accordance with claim 14 wherein said plurality of compressible and expandable members are divided into at least two different zones for providing different pressures.

18. The mattress in accordance with claim 14 wherein said plurality of compressible and expandable members are arranged in matrix arrangement.

19. The mattress in accordance with claim 14 wherein each of said plurality of compressible and expandable members includes a vertical hollow cylindrical shaped glands.

20. The mattress in accordance with claim 14 wherein said means for supplying air under pressure includes at least one inlet port interconnected to said base of said airtight structure.

21. The mattress in accordance with claim 14 wherein said restraining member includes a foam structure.

22. The mattress in accordance with claim 14 wherein each of said plurality of compressible and expandable member includes a wedge shaped end for providing a lifting effect to lift said restraining member to a desired height relative to an adjusted pressure.

* * * * *